US005217299A

United States Patent [19]

Yoshida et al.

[11] Patent Number: 5,217,299

[45] Date of Patent: Jun. 8, 1993

[54] REFLECTION TYPE LIGHTING APPARATUS

[75] Inventors: Kazushi Yoshida, Shizuoka; Yasuyuki Tejima, Tokyo, both of Japan

[73] Assignee: Asahi Kogaku Kogyo Kabushiki Kaisha, Tokyo, Japan

[21] Appl. No.: 752,031

[22] Filed: Aug. 29, 1991

[30] Foreign Application Priority Data

Sep. 4, 1990 [JP] Japan ..... 2-233989

[51] Int. Cl.[5] ..... F21V 7/02

[52] U.S. Cl. ..... 362/298; 362/346

[58] Field of Search ..... 362/298, 346, 339, 297, 362/302, 304

[56] References Cited

U.S. PATENT DOCUMENTS

| | | | |
|---|---|---|---|
| 1,227,694 | 5/1917 | Tatlow, Jr. | 362/298 |
| 4,458,303 | 7/1984 | Berns | 362/298 |
| 4,823,002 | 4/1989 | Saito . | |

FOREIGN PATENT DOCUMENTS

| | | | |
|---|---|---|---|
| 20188 | 10/1916 | France | 362/298 |
| 972902 | 9/1950 | France | 362/298 |
| 0148546 | 11/1979 | Japan | 362/298 |
| 59-143117 | 8/1984 | Japan . | |
| 60-77301 | 5/1985 | Japan . | |
| 62-195136 | 12/1987 | Japan . | |
| 1-10724 | 1/1989 | Japan . | |
| 2-116379 | 5/1990 | Japan . | |
| 2-116380 | 5/1990 | Japan . | |
| 2-236418 | 9/1990 | Japan . | |
| 176166 | 3/1922 | United Kingdom | 362/298 |

*Primary Examiner*—Richard R. Cole

*Attorney, Agent, or Firm*—Sandler, Greenblum & Bernstein

[57] ABSTRACT

A reflection type lighting apparatus includes a light source, a main mirror for reflecting light from the light source toward an illumination area to be illuminated, an auxiliary mirror for reflecting light from the light source toward the main mirror, and a light transmission portion surrounding the main reflection surface. The main mirror has a non-circular reflection surface which defines a light emission area. The auxiliary mirror has an auxiliary reflection surface with a center emission opening, to reflect light from the light source, transmitted through the light transmission portion, back towards the main mirror.

26 Claims, 4 Drawing Sheets

Fig. 1B
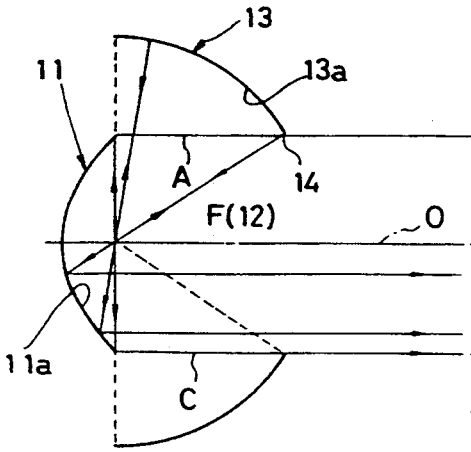
Fig. 1A
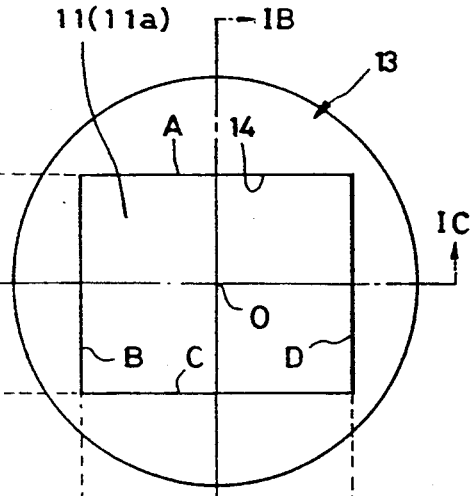
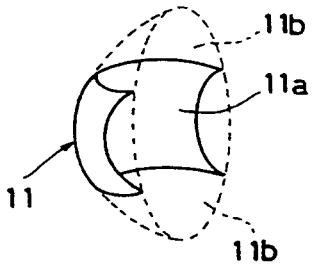
Fig. 1D
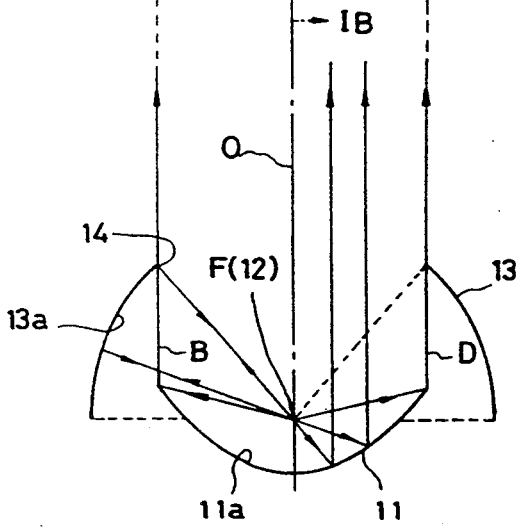
Fig. 1C

Fig. 2B
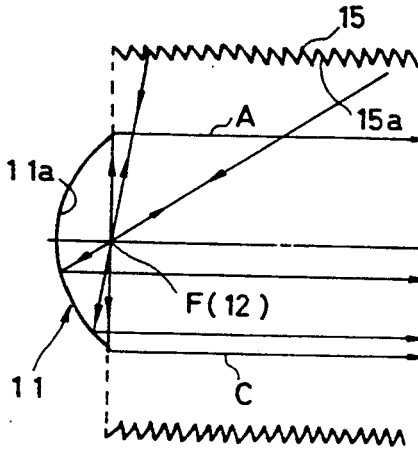
Fig. 2A
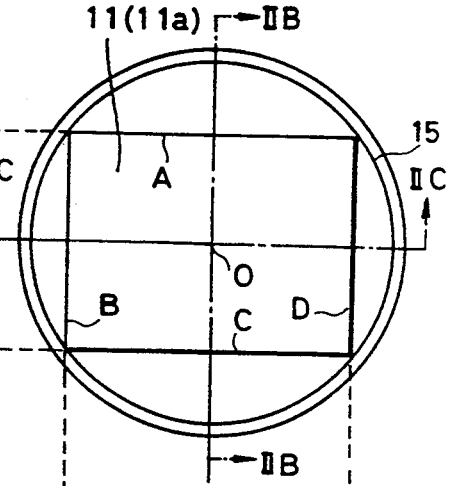
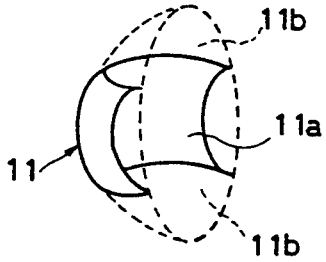
Fig. 2D
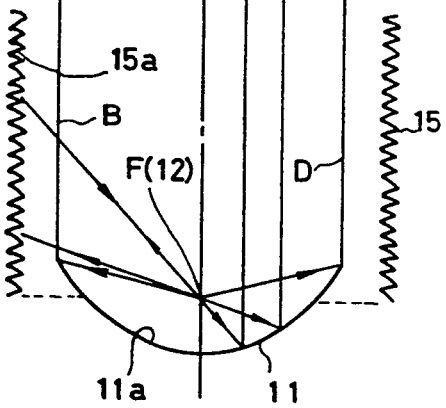
Fig. 2C

Fig. 3B
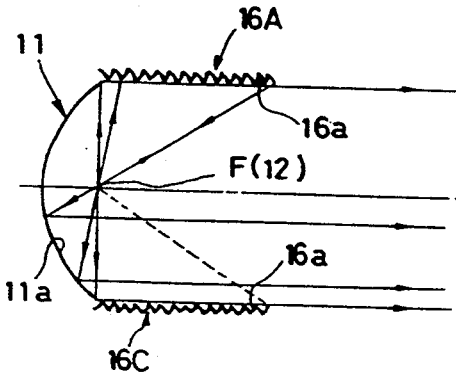
Fig. 3A
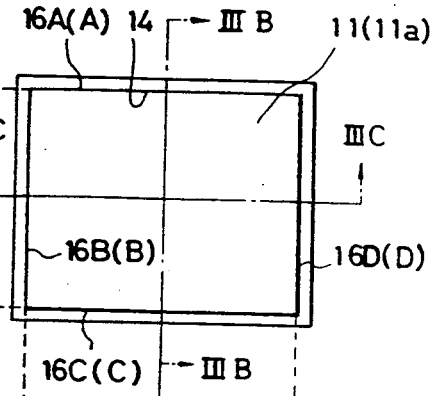
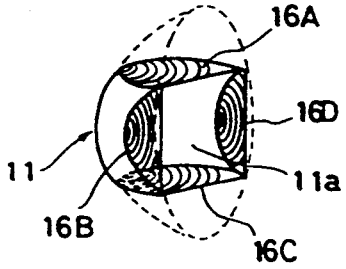
Fig. 3D
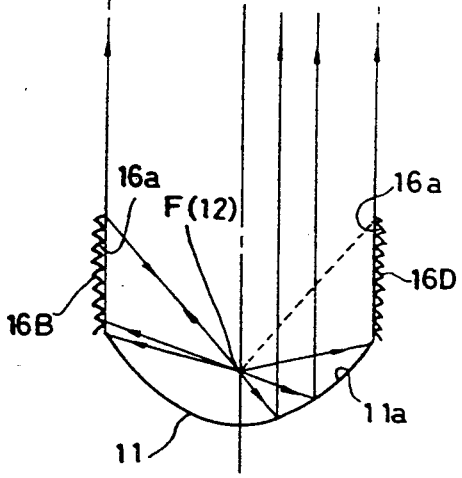
Fig. 3C

Fig. 4B
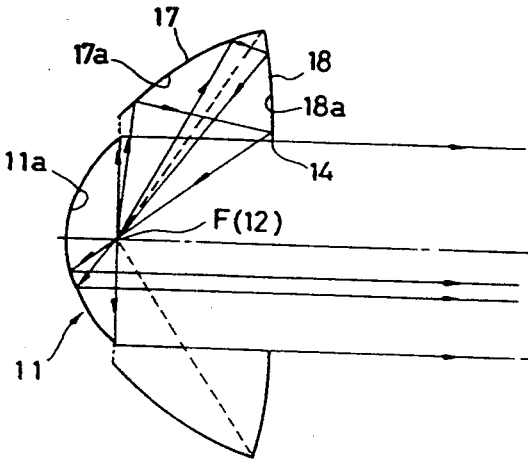
Fig. 4A
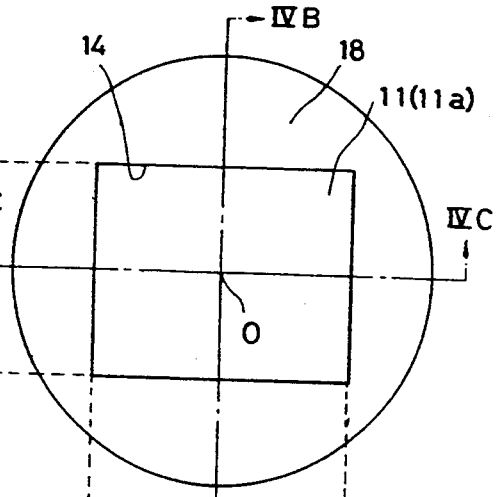
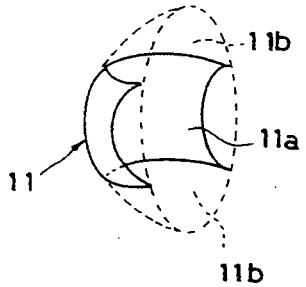
Fig. 4D
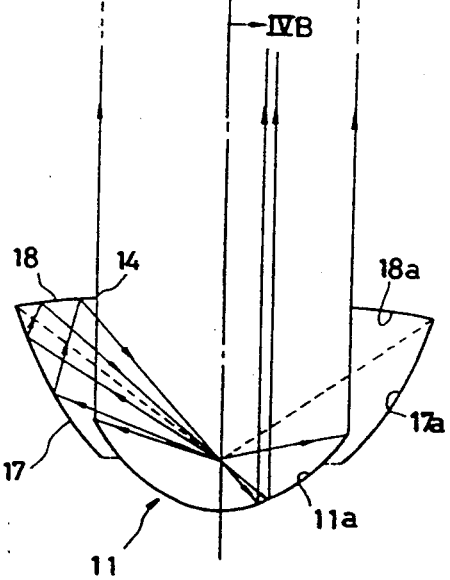
Fig. 4C

REFLECTION TYPE LIGHTING APPARATUS

BACKGROUND OF THE INVENTION

1. Field of the Invention

The present invention relates to a reflection type lighting apparatus, and more precisely, it relates to a reflection type lighting apparatus which can be advantageously used to make a non-circular illumination area.

This application is related to the commonly assigned application U.S. Ser. No. 694,335, the disclosure of which is expressly incorporated by reference herein.

2. Description of Related Art

The present application proposes a lighting apparatus which includes a main mirror and an auxiliary mirror which. Examples of which are disclosed in Japanese Patent Application Nos. 2-116379, 2-116380 and 2-236418 (and corresponding U.S. Ser. No. 694,335 filed on May 1, 1991). The proposed lighting apparatuses are featured by an auxiliary mirror which reflects the light from the light source toward the main mirror.

However, in the proposed lighting apparatuses, the main mirror and the auxiliary mirror are both circular in front elevation view, and accordingly, the illumination area is also circular. On the other hand, a transmission type liquid crystal projector having a rectangular picture plane requires a non-circular illumination area. In this projector, it is preferable that the emission opening of the auxiliary mirror have a shape corresponding to the shape of the illumination area (rectangular picture plane) to illuminate a non-circular area. However, the shape of the illumination area defined by the shape of the emission opening of the auxiliary mirror results in an increase in the amount of light that is lost. Namely, a portion of the light which is emitted from the light source and reflected by the main mirror is intercepted, and accordingly, the amount of light to be reflected by the main mirror and the auxiliary mirror is decreased, resulting in an inefficient utilization of light. In the transmission type liquid crystal projector, the utilization efficiency is usually less than 10% due to reflection and absorption of light. Consequently, if there is a loss at the light source portion, as mentioned above, the utilization efficiency is further reduced, which is not practicable.

SUMMARY OF THE INVENTION

The primary object of the present invention is to increase the light utilization efficiency in a lighting apparatus including a main mirror and an auxiliary mirror.

Another object of the present invention is to provide a reflection type of small lighting apparatus which can be advantageously used to illuminate a non-circular primary illumination area with a high light utilization efficiency.

To achieve the object mentioned above, according to the present invention, there is provided a lighting apparatus with a light source having a light emitting portion and a main mirror for reflecting light from the light source toward a primary illumination area to be illuminated. The main mirror is provided with a main reflection surface which is non-circular as viewed from the front in the optical axis direction thereof and defines a light emission area by the main reflection surface. An auxiliary mirror for reflects light from the light source toward the main mirror, and a light transmission portion surrounding the main reflection surface. The auxiliary mirror with center emission opening provided with an annular auxiliary reflection surface for reflecting light from the light source toward the main reflection surface of the main mirror, transmitted through the light transmission portion of the main mirror.

The main mirror can be a parabolic mirror, an elliptical mirror, or any aspherical mirror. The transmission portion is formed by cutting away a part of the main mirror. Alternatively, it is possible to make the main mirror of a transparent material which is partially coated with a reflection layer to define the reflection surface so that the remaining transparent portion of the main mirror defines the light transmission portion.

The auxiliary mirror is made of, in one possible configuration, a spherical mirror having a center located at the center of the light source in the vicinity thereof. The light emission opening formed in the auxiliary mirror is preferably shaped to correspond to the light emission area of the main mirror's reflection surface.

Alternatively, the auxiliary mirror can be made of a cylinder having a spherical Fresnel lens. In this alternative, the emission opening is circular.

Furthermore, it is also possible to make the auxiliary mirror of spherical Fresnel lenses in combination, lying in orthogonal planes parallel with the optical axis. The spherical Fresnel lenses define a light emission opening corresponding to the area of light emitted by the reflection surface of the main mirror. This modification makes it possible to realize a smaller lighting apparatus.

In another embodiment, the auxiliary mirror is made up of a combination of an elliptical mirror and a hyperbolic mirror. One of the focal points of the elliptical mirror is located at the center of the light source or in the vicinity thereof so that light from the light source emitted in the optical axis direction toward the main mirror is reflected toward the other focal point of the elliptical mirror. The hyperbolic mirror has focal points identical to those of the elliptical mirror so that light from the light source, reflected by the elliptical mirror is reflected back towards the light source. The light emission opening is defined by the center of the hyperbolic mirror.

In view of the size of the light source, the light emission opening of the auxiliary mirror is preferably shaped so as not to intercept effective light, thus increasing the light utilization efficiency.

The present disclosure relates to subject matter contained in Japanese patent application No. 2-233989 (filed on Sep. 4, 1990) which is expressly incorporated herein by reference in its entirety.

BRIEF DESCRIPTION OF THE DRAWINGS

The invention will be described below in detail with reference to the accompanying drawings in which:

FIG. 1A is a front elevational view of a lighting apparatus according to a first embodiment of the present invention;

FIGS. 1B and 1C are sectional views taken along the lines IB—IB and IC—IC in FIG. 1A, respectively;

FIG. 1D is a perspective view of a main mirror of the lighting apparatus shown in FIG. 1A;

FIG. 2A is a front elevational view of a lighting apparatus according to the second embodiment of the present invention;

FIGS. 2B and 2C are sectional views taken along the lines IIB—IIB and IIC—IIC in FIG. 2A, respectively;

FIG. 2D is a perspective view of the main mirror of the lighting apparatus shown in FIG. 2A;

FIG. 3A is a front elevational view of the lighting apparatus according to the third embodiment of the present invention;

FIGS. 3B and 3C are sectional views taken along the lines IIIB—IIIB and IIIC—IIIC in FIG. 3A, respectively;

FIG. 3D is a perspective view of the main mirror of the lighting apparatus shown in FIG. 3A;

FIG. 4A is a front elevational view of a lighting apparatus according to the fourth embodiment of the present invention;

FIGS. 4B and 4C are sectional views taken along the lines IVB—IVB and IVC—IVC in FIG. 4A, respectively; and, FIG. 4D is a perspective view of the main mirror of the lighting apparatus shown in FIG. 4A.

DESCRIPTION OF THE PREFERRED EMBODIMENTS

The illustrated embodiments are all applied to a lighting apparatus which illuminates a rectangular primary illumination area.

FIGS. 1A through 1D show a first embodiment of the invention in which a light source 12 is located on or in the vicinity of a focal point F of a main mirror (body) 11 which is, in one possible configuration, in the form of a parabolic mirror on an optical axis O. One of the most significant features of the present invention resides in the special configuration of reflection surface 11*a* of the main mirror 11, commonly applied to all embodiments of the invention.

Namely, the reflection surface 11*a* of the main mirror 11 has a rectangular shape as viewed in the direction of the optical axis O. The main mirror 11 has a parabolic surface symmetrical with respect to the optical axis O, and accordingly, to make the outgoing area (emission area) of light reflected from the reflection surface 11*a* rectangular, the reflection surface 11*a* must be shaped as shown in FIG. 1D. Namely, the shape of the reflection surface 11*a* is defined by a parabolic surface of rotational symmetry which is cut by four orthogonal planes A, B, C and D which are parallel to the optical axis O to define a rectangle in front elevation, as can be seen in FIGS. 1A and 1B. The area surrounding the reflection surface 11*a* defines a light transmission portion 11*b* through which light is transmitted. It is possible to define the light transmission portion 11*b* by a space which is obtained by partially cutting away the main mirror 11. It would also be possible to use a parabolic surface of transparent material with a rotational symmetry partially coated with a reflection coating to define the reflection surface 11*a* so that the remaining portion defines the light transmission portion 11*b*.

An auxiliary spherical mirror 13 is located outside the open end of the main mirror 11 with a reflection surface 13*a* opposed to the reflection surface 11*a* of the main mirror 11. The center of the reflection surface 13*a* of the auxiliary mirror 13 is located at the center of the light source 12 (the focal point F of the main mirror 11) or the vicinity thereof. In the center of auxiliary mirror 13 is a rectangular opening 14 corresponding to the rectangular area of light emitted by the reflection surface 11*a*.

Rays of light emitted from the light source 12 and reflected by the reflection surface 11*a* are all emitted in a direction parallel to the optical axis O through the emission opening 14 of the auxiliary spherical mirror 13. The rays of light emitted toward the outside area of the reflection surface 11*a* from the light source 12 are transmitted through the light transmission portion 11*b* and made incident upon the auxiliary reflection surface 13*a* of the auxiliary spherical mirror 13. Since the auxiliary reflection surface 13*a* is defined by a spherical section with the center on the focal point F of the parabolic mirror 11, the light reflected by the auxiliary reflection surface 13*a* is returned to the light source 12 along the same light path on which it was emitted. The light is then reflected by the main reflection surface 11*a* and emitted parallel to the optical axis O through the center emission opening 14 of the auxiliary mirror 13.

It should be recalled that the main reflection surface 11*a* is provided only in the portion of the parabolic surface of rotational symmetry corresponding to a predetermined emission area (rectangular area in the illustrated embodiments) so that the portion surrounding the main reflection surface 11*a* defines the light emission portion 11*b*. Light transmitted through the light transmission portion 11*b* is reflected by the auxiliary reflection surface 13*a* toward the reflection surface 11*a* so that the light is reflected by the reflection surface 11*a* in a direction parallel to the optical axis O through the emission opening 14 of the auxiliary mirror 13, resulting in a more efficient utilization of light.

The advantage of the present invention, i e., the increased light utilization efficiency can be seen if one compares the above optical arrangement with an optical arrangement in which the light transmission portion 11*b* is also a reflecting surface.

In the current embodiment, if the emission opening 14 of the auxiliary spherical mirror 13 is circular, an increase in light utilization can be expected to some extent. However, the largest light utilization efficiency is obtained when the light emission opening 14 has a shape corresponding to that of the emission area of light reflected by the surface 11*a*. If the light emission opening does not correspond to the emission area of the light reflected by the surface 11*a*, the light which is directly emitted from the light source 12 toward the unnecessary area outside the rectangular primary illumination area through the emission opening 14 is lost.

FIGS. 2A through 2D show a second embodiment of the present invention. In the second embodiment, an optical cylinder 15 having a spherical Fresnel lens is used in place of the auxiliary spherical mirror 13 in the first embodiment. The spherical Fresnel lens (cylinder) 15 is comprised of fine spherical Fresnel reflection surfaces 15*a* which are superimposed in the optical axis direction to form a cylinder, as is well known. The spherical Fresnel lens 15 is optically equivalent to the auxiliary spherical mirror 13. In the second embodiment, illustrated in FIGS. 2A through 2D, the emission opening is defined by the circular end of the cylinder 15. The shape of the main mirror 11 is identical to that of the main mirror 11 in the first embodiment.

According to the second embodiment, since the diameter of the cylinder (spherical Fresnel lens) 15 is made smaller than the auxiliary mirror 13 in the first embodiment, a smaller lighting apparatus can be realized.

FIGS. 3A through 3D show a third embodiment of the present invention. In the third embodiment, the four orthogonal planes A, B, C and D (FIG. 1A) which cut the reflection surface 11*a* of the main mirror 11 in parallel with the optical axis O are provided with spherical Fresnel lenses 16A, 16B, 16C and 16D as an auxiliary mirror, respectively. The plate like spherical Fresnel lenses 16A, 16B, 16C and 16D are connected to the reflection surface 11*a* of the main mirror 11. The arrangement of the third embodiment illustrated in FIGS. 3A through 3D is obtained using four plate like spherical Fresnel lenses 16A through 16D corresponding to the planes A, B, C, D resulting in a configuration optically equivalent to the second embodiment in which a cylinder like spherical Fresnel lens 15 is used. In the third embodiment each of the Fresnel lenses 16A through 16D has a fine reflection surface 16*a* per se known.

According to the third embodiment, a smaller lighting apparatus than the second embodiment can be realized. Furthermore, since the plate like spherical Fresnel lenses 16A through 16D can be easily manufactured, the whole manufacturing cost of the lighting apparatus can be reduced.

FIGS. 4A through 4D show a fourth embodiment of the present invention. In the fourth embodiment, an assembly of an elliptical mirror 17 and a hyperbolic mirror 18 is used as an auxiliary mirror. The hyperbolic mirror 18 has a rectangular emission opening 14 corresponding to the reflection surface 11*a*. One of the focal points of the elliptical mirror 17 is located on the focal point F of the main mirror 11 so that the reflection surface 17*a* of the elliptical mirror 17 reflects direct light from the light source 12 toward the other focal point of the elliptical mirror 17.

The hyperbolic mirror 18 has two focal points identical to the two focal points of the elliptical mirror 17. The reflection surface 18*a* of the hyperbolic mirror 18 is opposed to the reflection surface 17*a* of the elliptical mirror 17. The reflection surface 18*a* reflects light, which is reflected by the reflection surface 17*a* towards the other focal point of the elliptical mirror 17, toward the light source 12. Consequently, the same result as those of the previous embodiments can be realized in the fourth embodiment.

We claim:

1. A reflection type lighting apparatus comprising:

a light source having an optical axis defining an optical axis direction;

a main mirror for reflecting light from said light source in a direction parallel to said optical axis toward a primary illumination area to be illuminated, said main mirror being provided with a reflection surface which is non-circular as viewed from in front of said optical axis direction to define a light emission area by said reflection surface; and, an auxiliary mirror for reflecting light from said light source toward said reflecting surface of said main mirror, said auxiliary mirror being provided with a center emission opening, wherein said reflection surface along with said center emission opening solely define the primary illumination area to be illuminated.

2. A lighting apparatus according to claim 1, further comprising a light transmission portion surrounding said reflection surface of said main mirror.

3. A lighting apparatus according to claim 2, wherein said auxiliary mirror is located outside said main mirror and has a center at said light emitting portion of said light source or the vicinity thereof.

4. A lighting apparatus according to claim 3, wherein said auxiliary mirror comprises a spherical mirror.

5. A lighting apparatus according to claim 4, wherein said auxiliary mirror center emission opening has a shape substantially corresponding to the shape of said reflection surface of said main mirror in front elevation.

6. A lighting apparatus according to claim 5, wherein said auxiliary mirror comprises a cylinder having a spherical Fresnel Lens.

7. A lighting apparatus according to claim 5, wherein said auxiliary mirror comprises a plurality of spherical Fresnel Lenses in combination, lying in planes parallel with the optical axis to define the emission opening.

8. A lighting apparatus according to claim 3, wherein said auxiliary mirror comprises a parabolic mirror.

9. The reflection type lighting apparatus according to claim 1, said main reflection surface being rectangular.

10. A reflection type lighting apparatus comprising:

a light source;

a main mirror for reflecting light from said light source toward a primary illumination area to be illuminated, said main mirror being provided with a main reflection surface which is aligned along an optical axis that defines an optical axis direction, said main reflection surface being non-circular as viewed from the front in the optical axis direction thereof, said main reflection surface defining a light emission area;

a light transmission portion surrounding said main reflection surface; and, an auxiliary mirror for reflecting light from said light source transmitted through said light transmission portion toward said main reflection surface of said main mirror, said auxiliary mirror being provided with a center emission opening, wherein said main reflection surface along with said center emission opening solely define the primary illumination area to be illuminated.

11. A lighting apparatus according to claim 10, wherein said auxiliary mirror comprises a spherical mirror having a center located at said light source or the vicinity thereof.

12. A lighting apparatus according to claim 11, wherein said emission opening has a shape corresponding to the light emission area defined by said main reflection surface of said main mirror.

13. A lighting apparatus according to claim 12, wherein said main mirror has a focal point on which said center of said auxiliary mirror is substantially located.

14. A lighting apparatus according to claim 10, wherein said auxiliary mirror comprises a cylinder having a spherical Fresnel lens.

15. A lighting apparatus according to claim 10, wherein said auxiliary mirror comprises a plurality of spherical Fresnel lenses in combination, lying in planes parallel with said optical axis to define the emission opening corresponding to a light emission area defined by said main reflection surface of said main mirror.

16. A lighting apparatus according to claim 10, wherein said auxiliary mirror comprises an elliptical mirror and a hyperbolic mirror in combination, said elliptical mirror having focal points one of which is located at the center of said light source or the vicinity thereof to reflect direct light from said light source incident thereupon toward another focal point, said hyperbolic mirror having focal points located at said focal points of said elliptical mirror to reflect light from said light source, reflected by said elliptical mirror, toward said light source.

17. A lighting apparatus according to claim 7, wherein said hyperbolic mirror defines the center emission opening.

18. A lighting apparatus according to claim 13, wherein said main mirror has a focal point on which the center of said auxiliary spherical mirror is substantially located.

19. A lighting apparatus according to claim 18, wherein said emission opening has a shape corresponding to the light emission area of said main reflection surface of said main mirror.

20. A lighting apparatus according to claim 10, wherein the emission area defined by said main reflection surface of said main mirror and the emission opening are both rectangular.

21. The reflection type lighting apparatus according to claim 10, said main reflection surface being rectangular.

22. A reflection type lighting apparatus comprising:

a light source which is substantially aligned along an optical axis that defines an optical axis direction;

a parabolic mirror having a reflecting surface for reflecting light from said light source toward a primary illumination area to be illuminated, an auxiliary spherical mirror for reflecting light from said light source toward said parabolic mirror, said auxiliary spherical mirror being provided with a center emission opening; and, a light transmission portion surrounding said reflection surface of said parabolic mirror;

said reflection surface of said parabolic mirror and said emission opening of said auxiliary spherical mirror are non-circular as viewed from the front along said optical axis direction to define a light emission area by said reflection surface, wherein said reflection surface along with the emission opening solely define the primary illumination area to be illuminated.

23. A lighting apparatus according to claim 22, wherein said auxiliary spherical mirror comprises a cylinder having a spherical Fresnel Lens.

24. A lighting apparatus according to claim 22, wherein said auxiliary spherical mirror comprises a plurality of spherical Fresnel Lenses in combination, lying in planes parallel with said optical axis to define the emission opening.

25. A lighting apparatus according to claim 22, wherein said reflection surface of said parabolic mirror and the shape of said emission opening of said auxiliary spherical mirror in front elevation are both rectangular.

26. The reflection type lighting apparatus according to claim 22, said main reflection surface being rectangular.

* * * * *